US011295876B2

(12) United States Patent
Engels et al.

(10) Patent No.: US 11,295,876 B2
(45) Date of Patent: Apr. 5, 2022

(54) HIGH-VOLTAGE FEED-THROUGH, ELECTRICAL DEVICE HAVING A HIGH-VOLTAGE FEED-THROUGH, AND METHOD FOR PRODUCING THE ELECTRICAL DEVICE

(71) Applicants: Siemens Energy Global GmbH & Co. KG, Munich (DE); PFISTERER KONTAKTSYSTEME GMBH, Winterbach (DE)

(72) Inventors: Engelbert Engels, Cologne (DE); Thomas Friedel, Schorndorf-Miedelsbach (DE); Tim Schnitzler, Kreuzau (DE); Paul Lider, Siegburg (DE)

(73) Assignees: Siemens Energy Global GmbH & Co. KG, Munich (DE); Pfisterer Kontaktsysteme GmbH, Winterbach (DE)

( * ) Notice: Subject to any disclaimer, the term of this patent is extended or adjusted under 35 U.S.C. 154(b) by 0 days.

(21) Appl. No.: 16/965,101

(22) PCT Filed: Dec. 28, 2018

(86) PCT No.: PCT/EP2018/097063
§ 371 (c)(1),
(2) Date: Jul. 27, 2020

(87) PCT Pub. No.: WO2019/145111
PCT Pub. Date: Aug. 1, 2019

(65) Prior Publication Data

US 2021/0035713 A1 Feb. 4, 2021

(30) Foreign Application Priority Data

Jan. 25, 2018 (DE) ..... 102018201160

(51) Int. Cl.
*H01B 17/26* (2006.01)
*H01B 17/28* (2006.01)
*H01F 27/04* (2006.01)

(52) U.S. Cl.
CPC ..... *H01B 17/265* (2013.01); *H01B 17/28* (2013.01); *H01F 27/04* (2013.01)

(58) Field of Classification Search
CPC ..... H01F 27/04; H01F 27/02; H01B 17/265; H01B 17/301; H01B 17/26; H01B 17/00;
(Continued)

(56) References Cited

U.S. PATENT DOCUMENTS 2,889,396 A 6/1959 Boden et al.
3,073,891 A 1/1963 Barengoltz
(Continued)

FOREIGN PATENT DOCUMENTS

DE 8318181 U1 12/1983
DE 102007022641 A1 11/2008
(Continued)

*Primary Examiner* — Angel R Estrada
(74) *Attorney, Agent, or Firm* — Laurence A. Greenberg; Werner H. Stemer; Ralph E. Locher

(57) ABSTRACT

A high-voltage feed-through contains a securing flange for securing the high-voltage feed-through to a wall. The securing flange contains a retaining part and a moving part, wherein the moving part is mounted relative to the retaining part such that it can rotate in relation to a longitudinal direction of the high-voltage feed-through. An electrical device contains a fluid-tight housing and the high-voltage feed-through. A device connection part is provided for receiving and contacting the high-voltage feed-through.

13 Claims, 2 Drawing Sheets

(58) Field of Classification Search
CPC ..... H01B 19/00; H01B 17/56; H01B 7/00; H01B 17/30; H01R 13/53; H01R 4/70; H05K 5/03; H01H 9/02; H01H 9/0264; H01H 85/185
USPC ..... 174/142, 152 G, 153 G, 152 R, 138 R, 174/139, 138 F, 137 R, 5 R, 14 BH; 16/2.1, 2.2
See application file for complete search history.

(56) References Cited

U.S. PATENT DOCUMENTS

| | | | | |
|---|---|---|---|---|
| 4,370,514 | A * | 1/1983 | Matthaus | H01B 17/28 174/31 R |
| 4,387,266 | A * | 6/1983 | Matthaus | H01B 17/28 174/31 R |
| 8,150,230 | B2 * | 4/2012 | Tilliette | H01B 17/28 385/138 |
| 8,440,913 | B2 * | 5/2013 | Stull | H02B 5/00 174/161 R |
| 8,969,729 | B2 * | 3/2015 | Jahnel | H01B 3/52 174/142 |
| 2012/0018217 | A1 | 1/2012 | Siebens et al. | |
| 2013/0233617 | A1 | 9/2013 | Egels et al. | |

FOREIGN PATENT DOCUMENTS

| | | | |
|---|---|---|---|
| DE | 102012203712 | A1 | 9/2013 |
| DE | 102013011981 | B3 | 1/2015 |
| EP | 3142207 | A1 | 3/2017 |
| FR | 2865859 | A1 | 8/2005 |

* cited by examiner

HIGH-VOLTAGE FEED-THROUGH, ELECTRICAL DEVICE HAVING A HIGH-VOLTAGE FEED-THROUGH, AND METHOD FOR PRODUCING THE ELECTRICAL DEVICE

BACKGROUND OF THE INVENTION

Field of the Invention:

The invention relates to a high-voltage feed-through with an attachment flange for attaching the high-voltage feed-through to a wall.

Generally, the object of such a high-voltage feed-through is to insulate a high-voltage line, which is at high-voltage potential and comprises a current-carrying current conductor, from an environment that is essentially at ground potential. In this case, the wall is usually a housing of a high-voltage device or a wall in a high-voltage installation. An inner conductor of the high-voltage feed-through forms a part of the current conductor or is plugged into said current conductor.

A high-voltage feed-through of the type mentioned in the introduction is known from DE 10 2007 022 641 A1. Said document discloses an electrical device in the form of a transformer whose housing comprises a device connection part into which it is possible to plug a high-voltage feed-through so as to connect the transformer to a high-voltage network. It is possible by virtue of using a pluggable high-voltage feed-through of this type to mount the transformer with the high-voltage feed-through with the smallest possible outlay during the mounting procedure and to put said transformer into operation. The mating section of the high-voltage feed-through and the device connection part are configured in such a manner that it is possible to produce a reliable electrical contact between the inner conductor of the high-voltage feed-through and the device connection part, wherein the device connection part is electrically connected to other elements of the electrical device, such as by way of example a transformer active part that is arranged within the housing. Simultaneously, the connection to the boundary surfaces between the device connection part and the mating section is dielectrically sufficiently strengthened that operation at a high-voltage level is possible. Insulating layers of paper are usually wound around the inner conductor so as to produce the insulating body. The usually one-piece attachment flange is used so as to attach the high-voltage feed-through to the wall of the transformer housing, said attachment flange being essentially unable to move with respect to the housing of the high-voltage feed-through.

DE 10 2013 011 981 B3 discloses an apparatus for attaching a connection facility to a switching system or to a transformer, wherein by means of the connection facility by way of example a cable plug connector having a connected high-voltage cable may be connected to the switching system or the transformer. The known apparatus comprises an attachment element and a securing element that is able to rotate with respect to the attachment element about a longitudinal axis of the apparatus, wherein the cable plug connector, the plug-connector part of a feed-through or of any other electrical operating means that cooperates with the device connection part may be secured with respect to its rotational position by means of said securing element.

SUMMARY OF THE INVENTION

The object of the invention is to propose a high-voltage feed-through of the above-mentioned type that is as variable as possible in use.

The object is achieved in accordance with the invention by means of a generic high-voltage feed-through in which the attachment flange comprises a holding part and a movable part, wherein the movable part is mounted so as to be able to rotate relative to the holding part with respect to a longitudinal direction of the high-voltage feed-through. Accordingly, the attachment flange is configured in at least two pieces. The holding part may by way of example be fixed to a housing of the high-voltage feed-through or directly to an active part of the high-voltage feed-through. The movable part is mounted in such a manner as to be able to move with respect thereto. The movement of the movable part with respect to the holding part is in this case limited to possible production tolerances, to a rotational movement with respect to an axis of the longitudinal axis of the high-voltage feed-through. The longitudinal axis is usually defined by the progression of the inner conductor. The high-voltage feed-through in accordance with the invention has the advantage that even in higher voltage applications, by way of example above 500 kV, it may be mounted in a simple manner on a high-voltage device or on its wall. Said high-voltage feed-through may in addition be designed in a pluggable manner and may be used in conjunction with a device connection part. As is known, a high-voltage feed-through that is designed for high high-voltage applications above 500 kV is in fact long and heavy. If the high-voltage feed-through is designed for voltages above 500 kV, then its length may be more than 5 m, in particular more than 10 m. In such cases, it is possible for the weight of such a high-voltage feed-through to be accordingly several tons. In order to operate the high-voltage feed-through, it must be mounted to the wall or plugged into a device connection part that is already provided. A crane is usually used for this purpose and with the aid of said crane the high-voltage feed-through is inserted into a receiving receptacle in the wall or in the device connection part. Attachment means are used on the attachment flange and on the wall or the device connection part so as to fix the high-voltage feed-through and it is necessary for said attachment means to be aligned with one another with respect to their rotational position. By way of example, threaded holes on the attachment flange are brought into alignment with corresponding pins or screws on the wall, or conversely. However, as soon as the high-voltage feed-through is inserted into the corresponding receiving receptacle, the part of the high-voltage feed-through that is inserted into the receiving receptacle may no longer rotate on account of a friction connection between it and the receiving receptacle. The alignment of the attachment means is only possible by means of the movable part of the attachment flange. In a particularly simple variant, so as to attach the high-voltage feed-through to the device connection part, the attachment means may be provided on the movable part of the attachment flange. A further advantage of the high-voltage feed-through in accordance with the invention is that during the mounting procedure said high-voltage feed-through may be aligned as described above irrespective of the structure of the wall or of the device connection part, merely with the aid of the in part movable attachment flange.

It is preferred that the holding part is fixed with respect to an outer housing of the high-voltage feed-through, in other words essentially is unable to move. This further simplifies the structure of high-voltage feed-through and its mounting procedure in particular then if the holding part is designed as one piece. However, the holding part may also be designed as a multi-piece part. The holding part may by way of example also comprise movable parts. By way of example, the holding part may be able to tilt with respect to the outer housing, in other words may be able to rotate about an axis that extends in a perpendicular manner with respect to the longitudinal axis.

In accordance with one embodiment of the invention, the movable part is a rotating ring that is arranged in a concentric manner about the holding part. In this embodiment, it is particularly simple to align the movable part during the procedure of mounting the high-voltage feed-through. The installer may rotate the relatively light movable part about the relatively heavy other high-voltage feed-through.

It is preferred that the movable ring comprises on its inner face a protrusion that engages in an outer guide groove of the holding part. In this manner, it is possible to ensure that the two parts are only able to move with respect to one another essentially in the rotational direction about the longitudinal axis. It is not possible for the movable part and the holding part to tilt or cant. The guide groove is located in a suitable manner radially outside on the holding part.

In accordance with one preferred embodiment of the invention, the holding part is designed at least in two pieces with a first and a second annular element, wherein the first element comprises a first outer indentation and the second element comprises a second outer indentation, wherein after the elements have been brought together the two indentations form the guide groove. In this manner, it is possible to realize a particularly simple and cost-effective procedure of producing the attachment flange, wherein it is not necessary during the production procedure to work the guide groove into a one piece part.

It is particularly preferred that the high-voltage feed-through is pluggable. In this case, the high-voltage feed-through comprises an inner conductor that extends in a longitudinal direction between a high-voltage connection and a mating section of the high-voltage feed-through, wherein the mating section is configured so as to plug the high-voltage feed-through into a device connection part of an electrical device, wherein the mating section comprises an outer coating of a flexible insulating coating material. The advantages of the invention are particularly apparent in this embodiment. On account of the outer coating, the friction connection between the mating section and the device connection part is particularly good with the result that in this case only the movable configuration of the attachment flange renders it possible to use a high-voltage feed-through in an expedient manner precisely in the field of high voltages above 500 kV.

It is preferred that the insulating body of the high-voltage feed-through comprises field-controlling control inserts that are separated from one another by insulating layers, wherein the control inserts are arranged in a concentric manner around the inner conductor. The control inserts may be used by way of example by virtue of their configuration to perform a capacitive field control of the electrical field in the insulating body. The control inserts are arranged apart from manufacturing tolerances in a concentric manner around the inner conductor. Consequently, the control inserts form in a cross-section through the insulating body concentric or almost concentric circles or almost circles that do not however have to be completely closed. The control inserts may be designed by way of example from aluminum films.

It is preferred that the insulating body comprises a hardened resin. By way of example, the high-voltage feed-through may be saturated with a hardenable resin during the production process, by way of example after the insulating layers have been wound on. Consequently, the insulating characteristics of the insulating body are improved after the resin has hardened. The insulating body is in this case in the form of a compact block with the result that it is possible to forego a main insulation using a gas.

The invention relates moreover to an electrical device having a fluid-tight housing and a high-voltage feed-through, wherein a device connection part is provided so as to receive and contact the high-voltage feed-through.

Such an electrical device is known from the previously already mentioned DE 10 2007 022 641 A1.

The object of the invention is to propose such a device that may be put into operation in the simplest manner possible.

The object is achieved in the case of a generic electrical device by virtue of the fact that the high-voltage feed-through comprises an attachment flange so as to attach the high-voltage feed-through to a wall, wherein the attachment flange comprises a holding part and a movable part, wherein the movable part is mounted in such a manner as to be able to rotate relative to the holding part with respect to a longitudinal direction of the high-voltage feed-through.

The advantages of the electrical device in accordance with the invention are derived in particular from the previously described advantages of the high-voltage feed-through in accordance with the invention. The high-voltage feed-through in accordance with the invention may be used in conjunction with the electrical device in accordance with the invention in all the described variants, embodiments and combinations of preferred features.

It is preferred that the device connection part is attached by means of an attachment section to the housing from which a hollow receiving section that is made from an electrically non-conductive insulating material extends into the housing, wherein a metal contact part is arranged on a closed tapering end region, said metal contact part extending through the insulating material of the receiving section or increasing the length of said receiving section towards the closed end region. In accordance with this embodiment of the invention, each device connection part comprises an open-lying end approx. at the height of a housing cover of the housing of the electrical device and said open-lying end renders it possible to plug in the mating section of the high-voltage feed-through. A receiving section extends in the plugging-in direction from the attachment section of the device connection part into the interior of the housing, wherein the receiving section is made from an insulating material that provides the necessary insulation between the contact piece, which during operation is at a high potential, and the housing of the electrical device, by way of example a transformer, which is at a ground potential. In order in this case to provide the necessary dielectric strength, the receiving section and the mating section are designed in a shape that complements one another with the result that on account of the intrinsic weight of the high-voltage feed-through the mating section is firmly pressed against the inner wall of the receiving section in order in this manner to avoid voltage spikes between the high-voltage feed-through and the device connection part.

It is preferred that the contact part is connected via a current connection line, for example a winding connection line, which extends within the housing, to a winding by way of example to a winding of a transformer. By virtue of plugging the high-voltage feed-through into the device connection part, the inner conductor of the high-voltage feed-through lies against the contact part with the result that the high-voltage connection of the high-voltage feed-through is connected to a winding of the electrical device via the winding connection line.

In accordance with a further embodiment of the invention, the current connection line is equipped with a current sensor, by way of example a current convertor. By virtue of the fact that the current sensor is arranged within the housing, the costly procedure of integrating the current sensor into the line harness during the mounting procedure on site is no longer necessary. In other words, the electrical device in accordance with the invention may be put into operation quickly on site. A costly procedure of mounting the current sensor is avoided in the case of this embodiment. In an expedient manner, mounting orifices are provided in the housing in order to allow access to the current sensor or current sensors after the insulating fluid has been discharged.

Furthermore, the invention relates to a method for producing an electrical device with a fluid-tight housing and a device connection part so as to receive and contact a high-voltage feed-through.

The object of the invention is to propose such a method that may be implemented in the simplest manner possible even in the case of devices that are designed for high voltage applications above 500 kV.

The object is achieved in the case of a generic method by virtue of the fact that a high-voltage feed-through in accordance with the invention is inserted into the device connection part, wherein the movable part of the attachment flange of the high-voltage feed-through is rotated about the longitudinal axis of the high-voltage feed-through so as to align the attachment elements of the high-voltage feed-through with respect to attachment elements of the device connection part.

The advantages of the method in accordance with the invention arise in particular from the previously described advantages of the high-voltage feed-through in accordance with the invention and of the electrical device in accordance with the invention. In conjunction with the method in accordance with the invention, the high-voltage feed-through and the electrical device may of course be used in all embodiments and combinations of preferred features.

The invention is further explained below with reference to the exemplary embodiments described in the FIGS. 1 and 2.

DETAILED DESCRIPTION OF THE INVENTION

Figure 1:
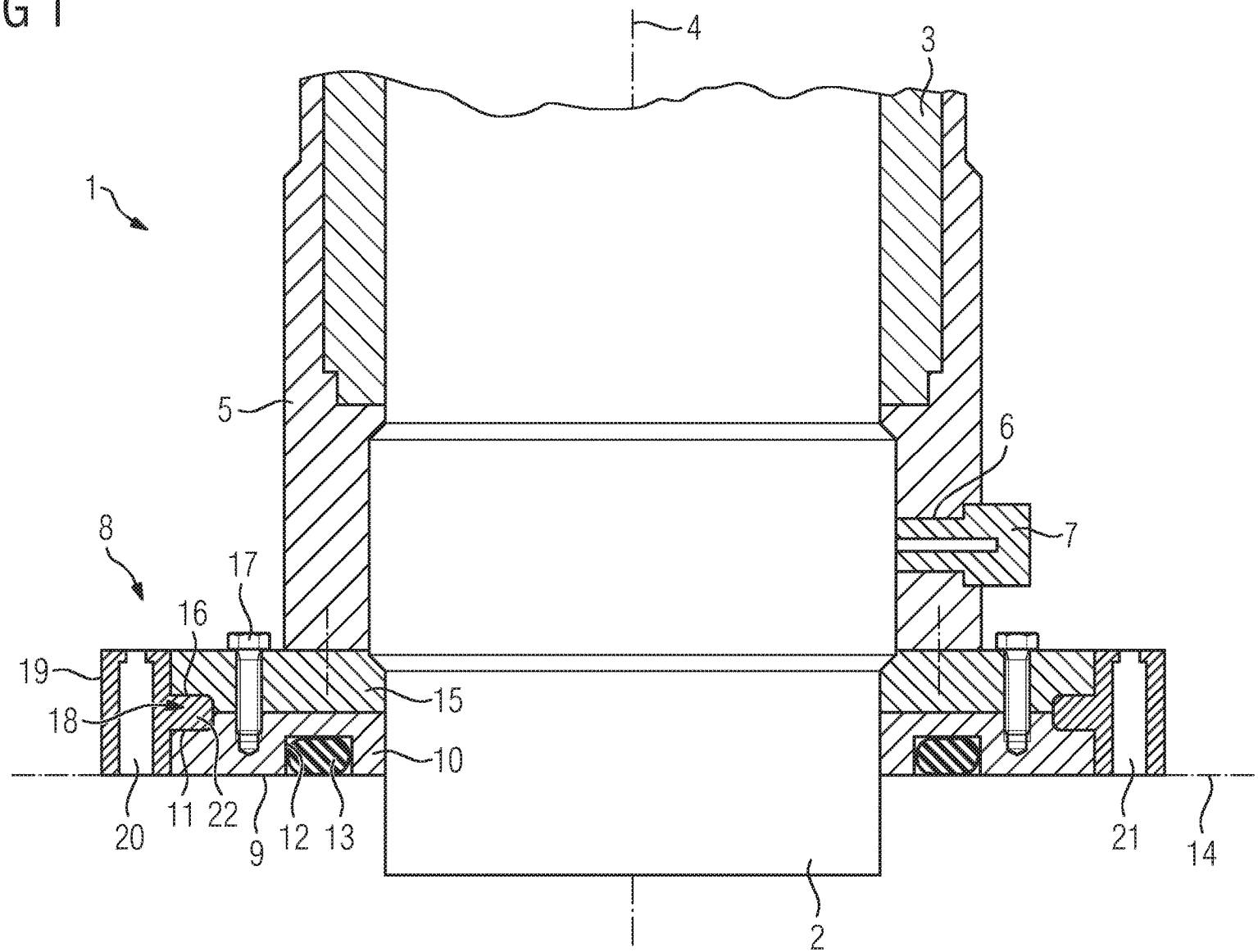
FIG. 1 illustrates a schematic cross-sectional view of a portion of an exemplary embodiment of a high-voltage feed-through in accordance with the invention.

FIG. 1 illustrates a sectional view of a portion of a high-voltage feed-through 1. The high-voltage feed-through 1 comprises an inner conductor 2. The inner conductor 2 is encompassed by an insulating body 3 that electrically insulates the inner conductor 2 from its environment. The inner conductor 2 extends along a longitudinal axis 4 of the high-voltage feed-through 1. The high-voltage feed-through 1 comprises moreover an outer housing 5 so as to mechanically protect the high-voltage feed-through 1. A potential tap 7 is inserted into a cut-out 6 in the housing 5. It is possible by means of the potential tap 7 to monitor a voltage and/or a current at the high-voltage feed-through 1. The potential tap 7 is accordingly configured so as to be connected to a measuring device.

An attachment flange 8 is provided so as to attach the high-voltage feed-through 1 to a wall 14. The attachment flange 8 extends in an axial manner from the inner conductor 2 outwards, wherein the inner conductor 2 is guided through the attachment flange 8. The attachment flange 8 comprises a holding part 9. The holding part 9 comprises a first element 10 that comprises a first indentation 11 and a recess 12 so as to receive a seal 13. The seal 13 is used so as to seal a boundary surface between the attachment flange 8 and the wall 14, which is indicated in FIG. 1 by means of a dot-dashed line. The first element 10 of the holding part 9 is arranged in an annular manner about the inner conductor 2. The holding part 9 comprises moreover a second element 15 that comprises a second indentation 16. The first and the second element 10, 15 are fixedly connected to one another by means of a screw connection 17. The holding part 9 is moreover fixedly connected to the outer housing 5 with the result that it is not possible for the housing 5 and the holding part 9 to move relative to one another. The first and the second indentation 11 or 16 form a guide groove 18. The attachment flange 8 comprises moreover a movable part that is designed as a rotating ring 19. The rotating ring 19 is arranged in a concentric manner with respect to the holding part 9 and the inner conductor 2 and is able to move about the longitudinal axis 4. The rotating ring 19 comprises a plurality of orifices 20, 21 that are configured so as to receive attachment means. The high-voltage feed-through 1 may be attached to the wall 14 using the attachment means that are inserted into the orifices 20, 21. The rotating ring 19 comprises on its inner face a protrusion 22. The protrusion 22 engages into the guide groove 18 with the result that the rotating ring 19 is guided during its rotating movement in the guide grove 18.

Figure 2:
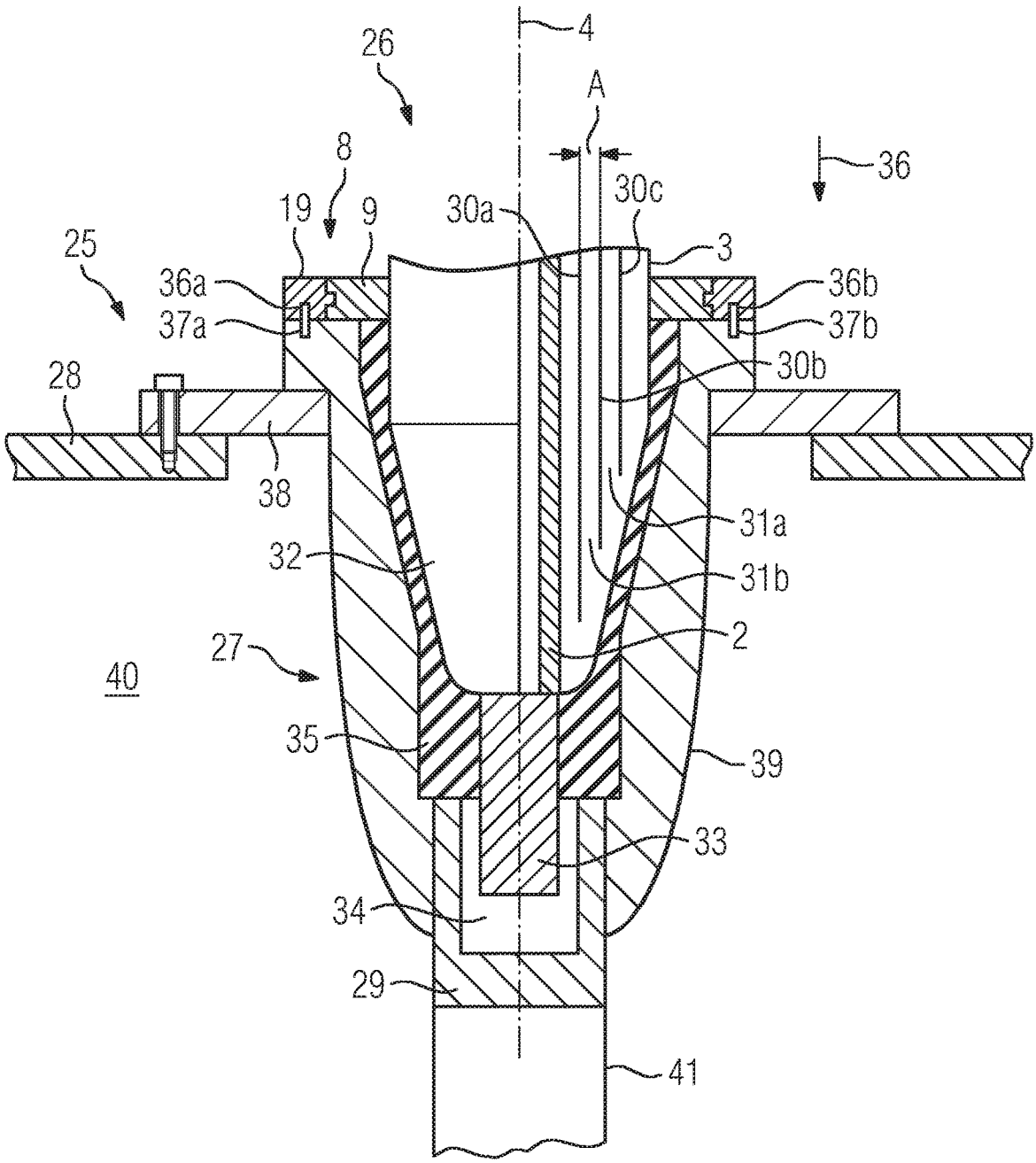
FIG. 2 illustrates a schematic cross-sectional view of a portion of an exemplary embodiment of an electrical device in accordance with the invention.

FIG. 2 illustrates a sectional view of a portion of an electrical device in the form of a transformer 25 with a pluggable high-voltage feed-through 26 and a device connection part 27 so as to receive and contact the high-voltage feed-through 26. In the illustration in FIG. 2, the high-voltage feed-through 26 is inserted into the device connection part 27 of the transformer 25. The device connection part 27 is attached to a housing wall 28. The housing wall 28 defines a transformer housing of the transformer 25 that is filled with an insulating means, by way of example insulating oil. The attachment arrangement is configured so as to be insulating means-tight with the result that the insulating means may not escape from the housing. The device connection part 27 comprises a conductive connection part 29 so as to produce an electrical connection between the high-voltage feed-through 26 and the current connection line 41 of a winding, not illustrated in the figure, of the transformer 25 that is arranged within the housing that is filled with insulating oil. Identical and similar components are provided with identical reference numerals in the FIGS. 1 and 2.

The high-voltage feed-through 26 comprises an inner conductor 2 that is designed in the illustrated example as a hollow conductor made from aluminum or copper. The inner conductor 2 is surrounded by an insulating body 3. The insulating body 3 comprises conductive control inserts 30*a-c* so as to perform a capacitive field control procedure, said control inserts being arranged in a concentric manner around the inner conductor 2. The control inserts 30*a-c* are separated from one another by means of insulating layers 31*a-b* that are made from a PET non-woven fabric and after being wound onto the inner conductor 2 are saturated with resin. The control inserts 30*a-c* are arranged in a radial spacing A of 2 mm with respect to one another.

The high-voltage feed-through 26 comprises moreover a mating section 32 for inserting the high-voltage feed-through 26 into the device connection part 27. The mating section 32 comprises a conically tapering part of the insulating body 3 and a connection conductor section that is welded in the form of a conductor bolt 33 to the inner conductor 2. A pluggable contact system 34 that produces the electrical connection between the high-voltage feed-through 26 and the transformer 25 is adjacent to the conductor bolt 33.

An intermediate space 35 between the mating section 32 of the high-voltage feed-through 26 and the device connection part 27 is filled with a silicone material that dielectrically strengthens the intermediate space 35.

The high-voltage feed-through 26 comprises moreover an attachment flange 8 having a holding part 9 and a movable part 19 in the form of a rotating ring. The holding part 9 is fixed to the insulating body 2 of the high-voltage feed-through 26. The movable part 19 is concentric and is able to rotate about a longitudinal axis 4 of the high-voltage feed-through 26.

So as to produce the electrical device 25, the high-voltage feed-through 26 is inserted into the device connection part 27 and in fact along the longitudinal axis 4 and in the direction that is indicated in FIG. 2 by an arrow 36. After the plug-in part 32 has been inserted into the device connection part 27, it is no longer possible to readjust the high-voltage feed-through 26 with respect to its rotational position. So as to align attachment elements 36a,b with respect to their intended position, the movable part 19 of the attachment flange 8 of the high-voltage feed-through 26 is rotated with respect to attachment elements 37*a,b* of the device connection part 27 about the longitudinal axis 4 of the high-voltage feed-through 26. Subsequently, the attachment flange 8 may be mechanically connected to the device connection part 27.

It is apparent that the device connection part 27 comprises an attachment section 38 with which it is fixedly mounted on the housing wall 28. By way of example, suitable screw connections are used for this purpose. Sealing means, not illustrated in the figure, are provided in order to attach the device connection part 27 in an insulating means-tight manner to the housing wall 28.

The device connection part 27 comprises moreover a receiving section 39 that is made from an electrically non-conductive material. In this case, the receiving section 39 tapers towards a closed end. At the closed end, the wall of the receiving section 39 is penetrated by a bolt-shaped connection part or contact part 29. At its section protruding into the interior space 40 or oil space of the housing, the contact part 29 is connected to a current connection line 41. The current connection line that is a winding connection line 41 in the illustrated exemplary embodiment is moreover equipped with a current sensor in the form of a current convertor (not illustrated in the figure). The current convertor is thus fixedly installed in the housing and is used so as to detect an electrical current that is flowing via the winding connection line 41 to or from the respective winding.

The mating section 32 of the high-voltage feed-through 26 extends from the attachment flange 8 into the receiving section 39 of the device connection part 27. In this case, the outer wall of the silicone-filled intermediate space 35 that is connected in a positive-locking manner to the mating section 32 is designed in a complementary shape to that of the receiving section 39 with the result that the two components lie against one another in a precise fit and air or other inclusions may be avoided.

The invention claimed is:

1. A high-voltage feed-through, comprising:

an attachment flange for attaching the high-voltage feed-through to a wall, said attachment flange having a holding part and a movable part, wherein said movable part is mounted so as to be able to rotate relative to said holding part about a longitudinal axis of the high-voltage feed-through defined by an inner conductor that extends along said longitudinal axis.

2. The high-voltage feed-through according to claim 1, further comprising an outer housing, said holding part is fixed with respect to said outer housing of the high-voltage feed-through.

3. The high-voltage feed-through according to claim 1, wherein said movable part is a rotating ring that is disposed in a concentric manner about said holding part.

4. The high-voltage feed-through according to claim 3, wherein:

said holding part has an outer guide groove formed therein; and said rotating ring has an inner face and on said inner face a protrusion is disposed that engages in said outer guide groove of said holding part.

5. The high-voltage feed-through according to claim 4, wherein said holding part is configured at least in two pieces including a first and a second annular element, wherein said first annular element has a first outer indentation formed therein and said second annular element has a second outer indentation formed therein, wherein after said first and second annular elements have been brought together said first and second outer indentations form said outer guide groove.

6. The high-voltage feed-through according to claim 1, further comprising:

a high-voltage connection;

a mating section configured so as to plug the high-voltage feed-through into a device connection part of an electrical device, said mating section having an outer coating of a flexible insulating coating material; and said inner conductor extending in a longitudinal direction between said high-voltage connection and said mating section of said high-voltage feed-through.

7. The high-voltage feed-through according to claim 1, further comprising an insulating body having field-controlling control inserts that are separated from one another by insulating layers, and wherein said field-controlling control inserts are disposed in a concentric manner around said inner conductor.

8. The high-voltage feed-through according to claim 7, wherein said insulating body contains a hardened resin.

9. An electrical device, comprising:

a fluid-tight housing;

a high-voltage feed-through having an attachment flange, said attachment flange having a holding part and a movable part, wherein said movable part is mounted so as to be able to rotate relative to said holding part to about a longitudinal axis of said high-voltage feed-through defined by an inner conductor that extends along said longitudinal axis; and a device connection part receiving and contacting said high-voltage feed-through.

10. The electrical device according to claim 9, wherein:

said device connection part has an attachment section, said device connection part is attached by means of said attachment section to said fluid-tight housing;

said device connection part has a hollow receiving section extending from an electrically non-conductive insulating material into said fluid-tight housing; and said device connection part has a metal contact part disposed on a closed tapering end region, said metal contact part extending through said electrically non-conductive insulating material of said hollow receiving section or increasing a length of said hollow receiving section towards the closed tapering end region.

11. The electrical device according to claim 10, further comprising a current connection line extending within said fluid-tight housing, said metal contact part is connected to a convertor winding via said current connection line.

12. The electrical device according to claim 11, wherein said current connection line is equipped with a current sensor.

13. A method for producing an electrical device having a fluid-tight housing and a device connection part so as to receive and contact a high-voltage feed-through, the high-voltage feed-through having an attachment flange for attaching the high-voltage feed-through to a wall, the attachment flange having a holding part and a movable part, wherein the movable part is mounted so as to be able to rotate relative to the holding part about a longitudinal axis of the high-voltage feed-through defined by an inner conductor that extends along said longitudinal axis, the method comprises the steps of;

inserting the high-voltage feed-through into the device connection part; and rotating the movable part of the attachment flange of the high-voltage feed-through about the longitudinal axis of the high-voltage feed-through so as to align attachment elements of the high-voltage feed-through with respect to attachment elements of the device connection part.

* * * * *